US006622899B1

(12) United States Patent
Klindworth-Garron

(10) Patent No.: US 6,622,899 B1
(45) Date of Patent: Sep. 23, 2003

(54) ACCESSORY BAG

(76) Inventor: Heidi Marie Klindworth-Garron, 10 Nosband Ave. - #2M, White Plains, NY (US) 10605

( * ) Notice: Subject to any disclaimer, the term of this patent is extended or adjusted under 35 U.S.C. 154(b) by 79 days.

(21) Appl. No.: 09/960,038

(22) Filed: Sep. 21, 2001

Related U.S. Application Data

(63) Continuation-in-part of application No. 09/561,419, filed on Apr. 28, 2000, now Pat. No. 6,299,044.

(51) Int. Cl.[7] ..... A45F 3/02

(52) U.S. Cl. ..... 224/578; 224/610; 224/617; 224/580; 224/625; 224/654

(58) Field of Search ..... 324/153, 614–618, 324/621, 625, 637, 627, 640, 663–665, 578–580, 604, 605, 610, 612, 626, 667, 650–655, 236–237; 150/107; 190/107; 383/13, 16, 29

(56) References Cited

U.S. PATENT DOCUMENTS

| | | | | | |
|---|---|---|---|---|---|
| 554,412 | A | * | 5/1896 | Choate | 224/616 |
| 778,636 | A | | 12/1904 | Coram | |
| 1,188,955 | A | * | 6/1916 | Leonard | 224/625 |
| 1,275,862 | A | * | 8/1918 | Danz | 224/610 |
| 2,224,568 | A | * | 12/1940 | Altorfer | 224/618 |
| 2,565,006 | A | | 8/1951 | Trickey | |
| 2,710,639 | A | | 6/1955 | Farls | |
| 4,350,274 | A | | 9/1982 | Morgan | |
| 4,515,300 | A | | 5/1985 | Cohen | |
| D280,465 | S | * | 9/1985 | Baum | 224/617 |
| 4,545,414 | A | | 10/1985 | Baum | |
| 4,810,102 | A | | 3/1989 | Norton | |
| 4,887,751 | A | | 12/1989 | Lehman | |
| 4,961,522 | A | | 10/1990 | Weber | |
| 4,998,653 | A | | 3/1991 | LaBelle | |
| 5,195,666 | A | * | 3/1993 | Yamaguchi et al. | 224/159 |
| 5,285,833 | A | | 2/1994 | Haxby | |
| 5,292,042 | A | | 3/1994 | Yamaguchi et al. | |
| 5,405,068 | A | | 4/1995 | Lovett | |
| 5,407,111 | A | | 4/1995 | Lanouette et al. | |
| 5,887,770 | A | * | 3/1999 | Covell | 224/578 |
| 5,957,354 | A | | 9/1999 | Mentken | |
| 6,123,239 | A | | 9/2000 | Lovitt | |
| 6,267,276 | B1 | * | 7/2001 | Cook | 224/625 |
| 6,299,044 | B1 | * | 10/2001 | Klindworth-Garron | 224/625 |
| 6,474,523 | B2 | * | 11/2002 | Morrison et al. | 224/578 |

* cited by examiner

*Primary Examiner*—Nathan J. Newhouse
(74) *Attorney, Agent, or Firm*—Cowan, Liebowitz & Latman, P.C.; Mark Montague

(57) ABSTRACT

An accessory bag, such as a handbag or pocketbook, includes front, rear and two side surfaces which are attached to the forward and rear surfaces. Each side surface includes a shoulder strap connector and a waist strap connector for selectable connection to a shoulder strap and a waist strap, respectively. Each side surface also includes a strap cover that can be open or closed, and which conceals at least portions of both the shoulder and waist strap connectors when closed, and fully reveals those connectors when open. Any of the strap connectors can be positioned to be fully concealed by the closed strap cover when not in use.

30 Claims, 12 Drawing Sheets

ACCESSORY BAG

RELATED APPLICATION

This application is a continuation-in-part of U.S. application Ser. No. 09/561,419, filed Apr. 28, 2000, now U.S. Pat. No. 6,299,044, issued Oct. 9, 2001. The disclosure of U.S. Pat. No. 6,299,044 is incorporated herein by reference.

FIELD OF THE INVENTION

The present invention relates to an accessory bag and, more particularly, to an accessory bag, such as a ladies' handbag or purse, that can be utilized with a detachable shoulder strap and/or with an adjustable/detachable waist-belt.

BACKGROUND OF THE INVENTION

Typical accessory bags are held by the wearer using a shoulder strap. Other types of accessory bags, known commonly as "fannie-packs," are held around the wearer's waist by a waist-belt. While both types of bags are convenient and provide various advantages to the wearer, various shortcomings are experienced by each. For example, fannie-packs, waist pouches, and the like, are utilized in informal settings and allow the wearer to carry various items, such as lipstick and cosmetic cases, purses, a cellular telephone, etc., while at the same type allowing the wearer to freely use one's hands and shoulders for other purposes. Unfortunately, these types of handbags often are inappropriate for more formal settings. On the other hand, while handbags or purses having a shoulder strap may be appropriate for formal settings, they require use of the wearer's shoulder to carry the handbag which may be disadvantageous in other settings. For example, these handbags are less secure than waist pouches since the shoulder strap and attached handbag are plainly visible and may be vulnerable to "purse snatchers," whereas waist pouches generally are hidden and are more secure near the wearer's waist. One common way to overcome this problem is to "secure" the shoulder strap bag diagonally across one's body (e.g., right shoulder to left hip), but this approach seriously detracts from the wearer's appearance. Another disadvantageous feature of bags having shoulder straps is the inability to properly wear the bag while performing various activities, including jogging, dancing, bicycle riding, etc. In such cases, the bag typically moves sporadically which may cause damage to the contents of the bag, injury to other persons as well as to the wearer, and presents a negative appearance altogether.

Given the advantages and disadvantages of bags with shoulder straps and waist-belts discussed above, there are times when there is a need for a bag that embodies the advantages of both types of bags. For example, a career woman typically carries a somewhat "formal" type of handbag using a shoulder strap in the business setting, but in a less formal setting, there may be a need to maintain that handbag around one's waist. This would include visits to nightclubs where it is desirable not to leave the handbag unattended and to not have the handbag move sporadically during, for example, dancing. Also, protection of the handbag while traveling in populated cities is desired without having to place the shoulder strap across one's chest.

OBJECTS OF THE INVENTION

It therefore is an object of the present invention to provide a handbag that can be utilized with both a shoulder strap and a waist belt.

It is a further object of the present invention to provide a handbag having the above indicated feature of being able to be used with different types of straps in an aesthetically pleasing manner.

Various other objects, advantages and features of the present invention will become readily apparent to those of ordinary skill in the art, and the novel features will be particularly pointed out in the appended claims.

SUMMARY OF THE INVENTION

In accordance with the present invention, an accessory bag meant to worn by a wearer is provided with front, rear and two side surfaces, each of the side surfaces being attached to the forward and rear surfaces. Each side of the accessory bag includes respective shoulder and waist strap connectors for connection to shoulder and waist straps, and a strap cover movable between open and closed positions that conceals at least portions of both the shoulder and waist strap connectors when in the closed position.

As an aspect of the present invention, each of the shoulder and waist strap connectors includes a ring movable between respective first and second positions, and where the strap covers when in the closed positions fully conceal the rings that are in their respective first position, and partially expose the rings that are in their respective second position.

As another aspect of the present invention, each of the shoulder and waist strap connectors includes a respective fixed component affixed to the side surfaces of the accessory bag and an attached ring, where the rings are for connection to respective ends of either of a shoulder or waist strap, and the rings are movable between extended and retracted positions. The strap covers when closed conceal those rings that are in the retracted position and partially reveal those rings that are in the extended position.

As a further aspect of the present invention, the shoulder strap connectors extend upwardly from the respective side surfaces of the accessory bag, and the waist strap connectors extend sideways from the side surfaces.

As yet another aspect of the present invention, each of the shoulder and waist strap connectors is a ring, and each strap cover is a single piece of material having a fixed body portion affixed to the accessory bag, a movable body portion that extends from the first body portion, and two narrow extension portions that extend from the fixed body portion, where the two narrow extension portions retain a respective connection ring.

In accordance with another embodiment of the present invention, an accessory bag includes a first strap connector for connection to a shoulder or waist strap and which is coupled to one of the side surfaces of the accessory bag, and a second strap connector for connection to a shoulder or waist strap and which is coupled to the other side surface of the accessory bag. Each of he first and second strap connectors is pivotable between a shoulder position and a waist position, and strap covers when closed conceal at least a portion of the strap connectors whether they are in either the shoulder position or the waist position.

In accordance with a further embodiment of the present invention, an accessory bag includes forward, rear, bottom and two side surfaces, where each of the side surfaces are attached to the forward, rear and bottom surfaces along respective seams. The accessory bag further includes a first pair of attachment devices for receiving respective ends of a shoulder-strap, and a second pair of attachment devices for receiving respective ends of a waist-strap. A first pair of retaining material is coupled to the accessory bag along respective first seams of the side surfaces for retaining the first pair of attachment devices, and a second pair of retaining material is coupled to the accessory bag along respective second seams, different from the first, for retaining the second pair of attachment devices.

As an aspect of this embodiment, the first pair of retaining material is coupled to the accessory bag along seams that attach the side surfaces to the bottom surface, and the second pair of retaining material is coupled along seams that attach the side surfaces to the front surface.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF CERTAIN PREFERRED EMBODIMENTS OF THE INVENTION

Figure 1A:
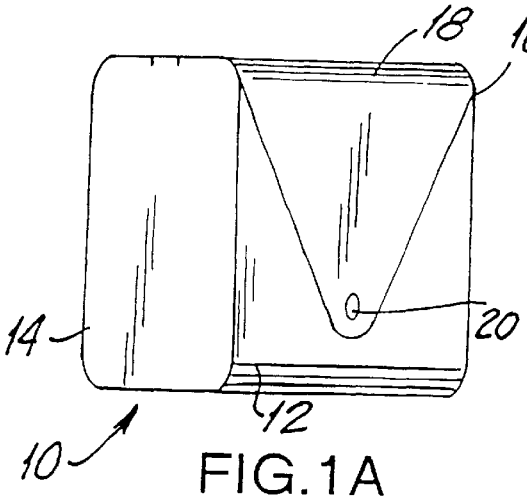
FIGS. 1A to 1E schematically illustrate different points of construction of the accessory bag of the present invention.

The accessory bag, also called handbag herein, of the present invention includes various strap holders, coverings, a strap and the handbag component, as further discussed below, that realizes the above-mentioned objectives. The accessory bag of the present invention initially is described with regard to the construction thereof. Referring now to FIGS. 1A–1E of the drawings, FIG. 1A illustrates the accessory bag 10 of the present invention in basic form which includes a front face 12, side faces 14, 16, a cover 18 and a clasp 20 adapted to secure cover 18 to front face 12. Although not shown in the drawings, the accessory bag may include a bottom face or, alternatively, the bottom may be defined by the attachment of the front and rear faces at the bottoms thereof. Of course, the accessory bag of the present invention may have a different basic construction such as known in the art. For example, rather than including a cover, clasp 20 may be located near the top of the bag so that the top of front face 12 may be detachably connected to the top of the bag's rear face (not shown). Further, the type of clasp 20 is not considered pertinent to the present invention and may be disregarded altogether. Still further, bag 10 of the present invention may be made of any suitable material that is known in the art. The styles and shape of bag 10 may be different than that depicted.

Figure 1B:
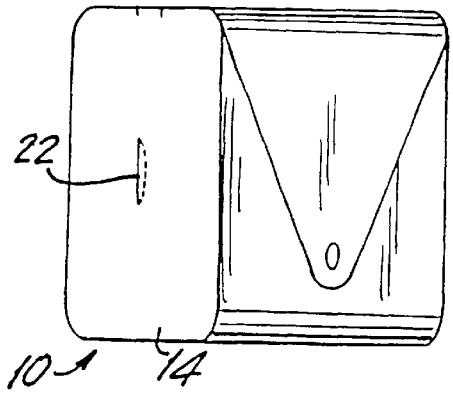
Figure 1C:
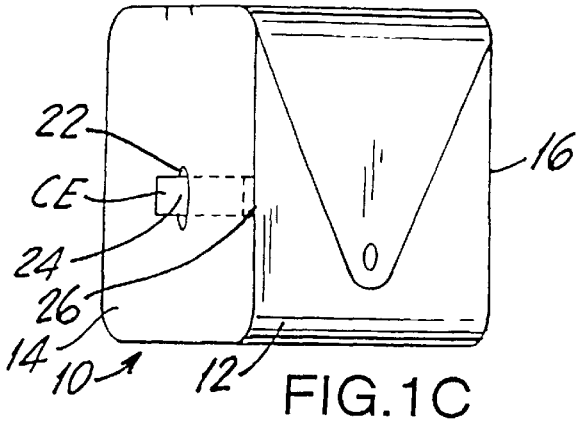
Figure 2:
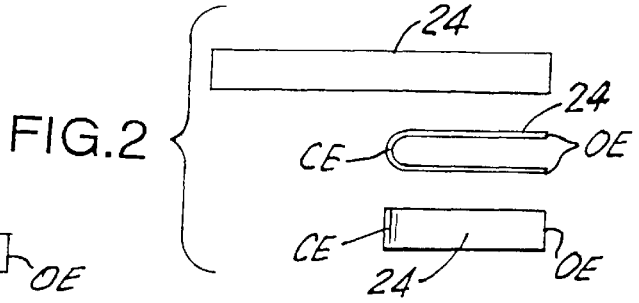
FIG. 2 schematically illustrates folded material utilized for attachments in accordance with the present invention.

Referring now to FIG. 1B, bag 10 of a first herein-described embodiment of the present invention is manufactured by making a bilateral incision 22 (or other appropriate incision) into side faces 14, 16. Incision 22 may vary in dimension as would seem appropriate. As shown in FIG. 1C, a suitably strong piece of material 24 is placed to extend partially through incision 22. Material 24 is formed as shown in FIG. 2, wherein a piece of material is folded in half to form an open end OE, where the ends of the material overlap, and a closed end CE, which generally is the midway point along the length of the material. Referring back to FIG. 1C, the closed end CE of material 24 extends through incision 22 disposed external to bag 10 of the present invention, and the open end OE is disposed within the bag (so as to not be visible) and is sewn into a seam 26 that is utilized to connect side face 14 to front face 12. Alternatively, the open end OE may be sewn into a seam connecting side face 14 to the rear face of bag 10.

Figure 1D:
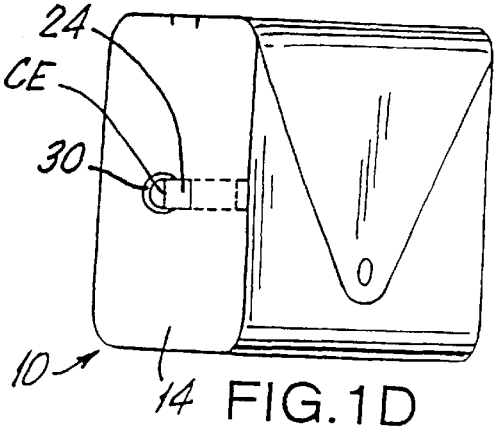
Figure 1E:
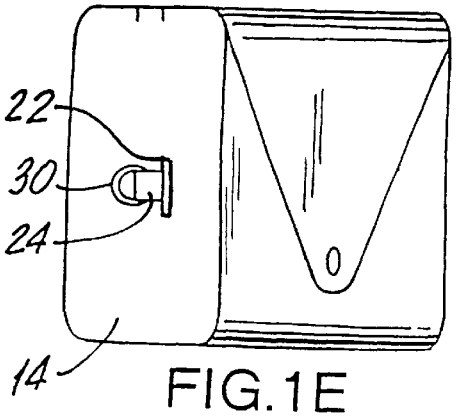

After the closed end CE of material 24 is inserted through incision 22, a ring 30 (e.g., a metal circular ring, a D-ring, etc.), loop or other suitable strap holder is connected to the closed end CE, as shown in FIG. 1D. Alternatively, material 24 is placed through ring 30 prior to being sewn in the bag's seam should it be desired to use a ring or other strap holder that is not easily connected to a closed ended piece of material. After the ring 30 is attached, incision 22 is sewn closed thus only revealing the closed end CE of material 24 extending from side face 14 of the bag with ring 30 displaced through the material, as shown in FIG. 1E.

The above steps and construction are applied to the other side surface 16 of bag 10 of the present invention. Thus, bag 10 includes two rings that, as will be discussed below, are adapted to be used as holders for a waist strap.

Figure 3A:
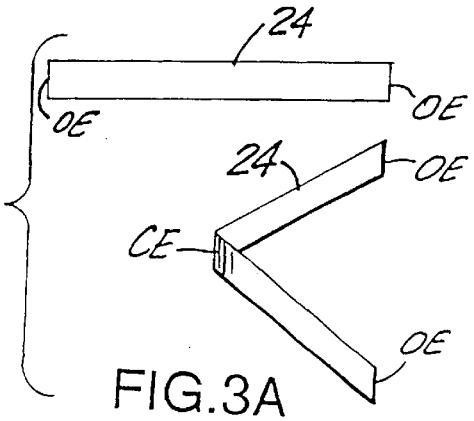
FIGS. 3A and 3B schematically illustrate construction of the waist-strap attachment in accordance with another embodiment of the present invention.
Figure 3B:
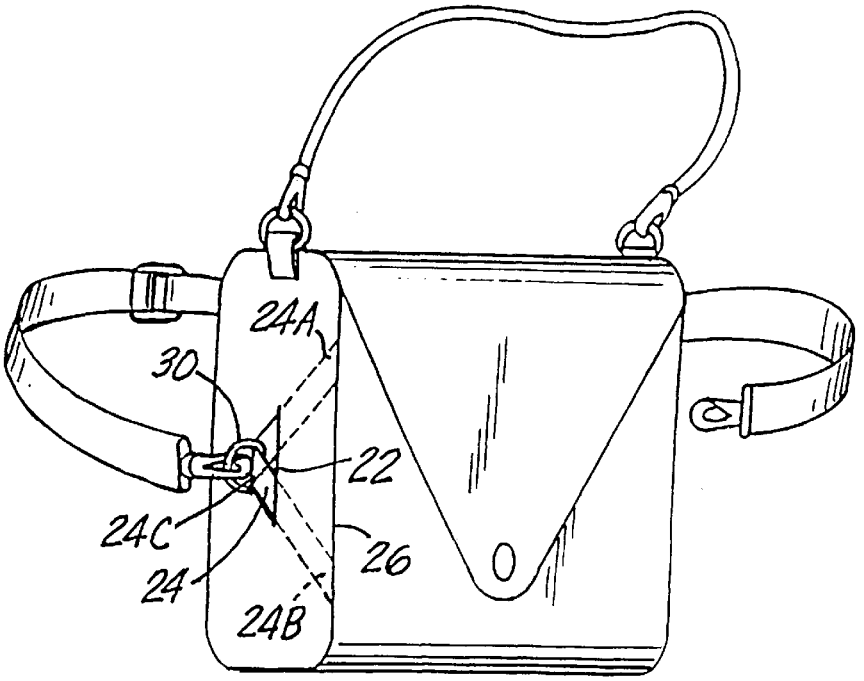

Material 24 discussed above is described as being folded in half prior to being sewn to the accessory bag of the present invention. In an alternative embodiment, and as shown in FIGS. 3A and 3B, material 24 may be folded in half in the manner shown in FIG. 3A wherein the two open ends OE remain apart from one another. In this case, one open end 24A of the material is sewn into seam 26 at a position separate from that position at which open end 24B of the material is sewn. In general, open end 24A may be sewn into the seam near the top of the accessory bag whereas open end 24B may be sewn into the seam near the bottom of the accessory bag. This structure tends to be substantially stronger than the embodiment described above (as shown in FIG. 1C) with the further advantage that material is spread out along the seam thus preventing any bulging that otherwise would occur. Moreover, FIG. 3B shows that this construction allows for the closed end 24C of the material to appear somewhat different and more fanciful than the design previously described, with ring 30 or other strap connector being coupled thereto in like manner.

Figure 4:
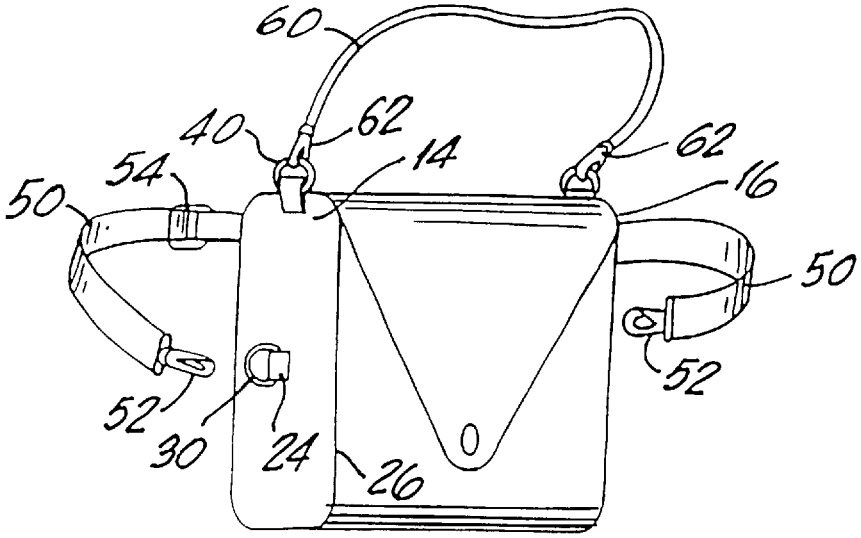
FIG. 4 schematically illustrates the accessory bag of the present invention shown with detachable waist and shoulder straps.

Turning now to FIG. 4, accessory bag 10 of the present invention includes a pair of shoulder straps 40 coupled to the bag in any manner well known in the art. For example, straps 40 can be in the form of D-rings or circular rings coupled to side surfaces 14, 16 (or even to a top surface) via appropriate material or device. The specific construction of the shoulder straps is not considered pertinent to the present invention.

The accessory bag of the present invention is adapted to be worn with a waist-strap 50, such as shown in FIG. 4, which includes appropriate connectors 52 and a size adjustment mechanism 54 for allowing the waist strap length to be adjusted. The accessory bag of the present invention further may be worn with a shoulder strap, such as strap 60 having two connectors 62 as shown in FIG. 4. Shoulder and waist straps are well known in the art and thus further description thereof is omitted herein.

In accordance with a further feature of the present invention, ring 30 and the visible portion of material 24 (on each side of the bag), which operate as the bag's waist-strap connector, may be covered in various novel manners to provide an aesthetically pleasing appearance as well as to provide additional strength to the connector, as discussed below.

Figure 5A:
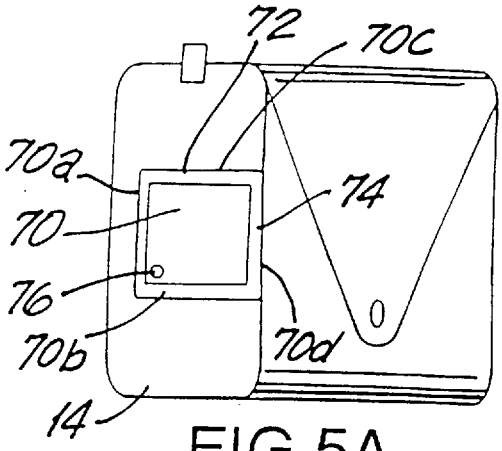
FIGS. 5A to 5C schematically illustrate various alternative embodiments of the feature of covering the waist-strap connectors in accordance with the present invention.

Referring to FIG. 5A, the accessory bag 10 of the present invention includes a cover 70 partially sewn to side face 14. Cover 70 is shown square but may be rectangular to accommodate bags of varying dimensions. Cover 70 may have other shapes including round, oval, star-like, etc., A similar cover is partially sewn in side face 16 (not shown) in like manner. In accordance with the structure shown in FIG. 5A, cover 70 is positioned to fully cover ring 30 and the closed end of material 22 (thus not shown in FIG. 5A) and is coupled to bag 10 by means of seams 72, 74 along respective ends 70*c*, 70*d* of cover 70 sewn into side face 14. Ends 70*a*, 70*b* of cover 70 are not sewn to the bag so that ring 30 may be accessed by simply lifting the loose corner of cover 70 in order to connect or disconnect a waist-strap to/from ring 30. Optionally, connectable snaps 76 may be attached to the cover's loose cover and the opposing surface on the bag to prevent the cover from flapping. With or without a snap, however, cover 70 provides an aesthetically pleasing appearance, especially when the accessory bag of the present invention is utilized with a shoulder-strap in a formal setting.

In accordance with a further additional feature of the present invention, seam 74 is sewn through the open ends of material 24 in either configuration shown in FIG. 1C or FIG. 3B, thus providing additional strength to the coupling mechanism that ultimately attaches to a waist-strap. Seam 74 may be adjacent to or on top of seam 26. This is especially important in light of the amount of strength that is required to maintain a tight fit around one's waist when using a waist-strap. Alternatively, seam 26 is used to attach cover end 70*d* to the accessory bag, rather than provide two separate seams.

Figure 5B:
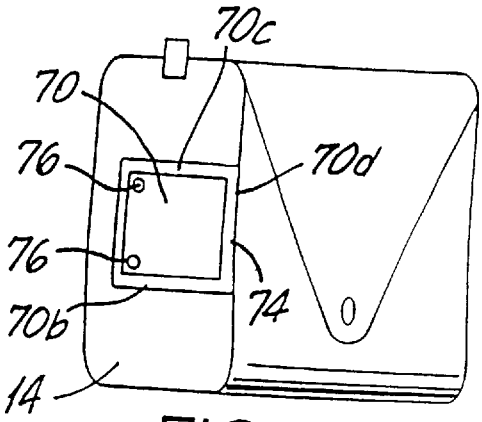

FIG. 5B shows an alternative design for attaching cover 70 to the accessory bag. While similar to the design shown in FIG. 5A, cover 70 is sewn to side 14 only along a single seam 74, leaving three ends 70*a*, 70*b*, 70*c* loose, and two snaps 76, 76 are provided to allow the wearer to gain access to ring 30 (not shown in FIG. 5B) to connect and detach a waist-strap. Like the design discussed with reference to FIG. 5A, seam 74 may be adjacent to, on top of, or the same as seam 26.

Figure 5C:
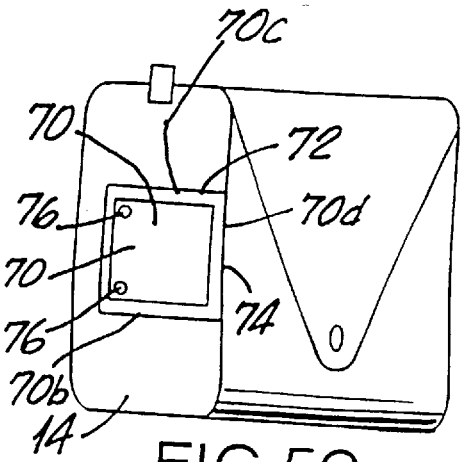

FIG. 5C shows yet another alternative design for attaching cover 70 to the accessory bag. In this design, cover 70 is sewn to side 14 along three of its sides 70*b*, 70*c*, 70*d*, leaving only the single side 70*a* open. Then, depending on the type of material used for cover 70 as well as the various sides of the accessory bag 10 of the present invention, two snaps 76 optionally may be installed to ensure that cover 70 appears "natural" on bag 10.

As can be appreciated from the above description of the various embodiments of the accessory bag of the present invention, a formal type of handbag embodying the various features discussed herein may be utilized in a somewhat formal setting that requires the use of a shoulder strap. In such case, the above-described cover and the particularly described designs suitably hide from view generally unfashionable waist-strap connectors. The cover's seam as well as the disclosed snaps provide for an aesthetically pleasing appearance. The cover additionally and advantageously provides added strength to the particular mechanism that is utilized with a waist-strap. Namely, the coupling mechanism. Still further, the coupling mechanism, even without the cover, is designed to be substantially strong for suitable use with a waist-strap. All of these features, individually and collectively, provide an accessory bag that overcomes various shortcomings encountered by currently existing designs.

Referring next to FIGS. 6–17 of the drawings, an accessory bag in accordance with another embodiment of the present invention is disclosed. As will be appreciated from the following discussion, each of the advantages previously mentioned with respect to the various designs shown in FIGS. 1A through 5C likewise are applicable to the embodiment of FIGS. 6–17.

Figure 6:
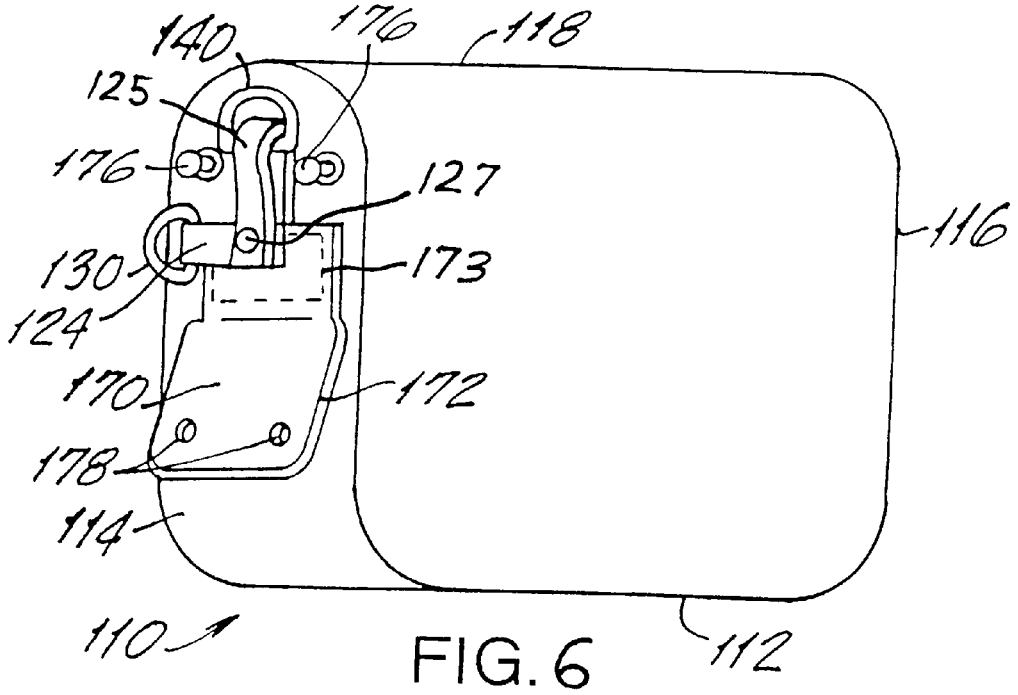
FIG. 6 schematically illustrates the accessory bag in accordance with a further embodiment of the present invention, shown with the strap cover disconnected.

In this described embodiment, and referring first to FIG. 6, there is shown an accessory bag 110 (or handbag) that has a basic construction similar to that previously described. Namely, accessory bag 110 of the present invention includes a front face (or surface) 112, side faces 114, 116, and a cover 118. A clasp (e.g., see FIG. 1A) optionally may be included that secures cover 118 to front face 112. Also, and also not shown, accessory bag 110 may include a bottom face and other additional and/or alternative features previously mentioned with respect to the designs previously described. Moreover, the shape and size of accessory bag 110 may be different from that shown.

Still referring to FIG. 6, accessory bag 110 includes on each of its sides faces 114 and 116 (only shown for side face 114) a strap cover 170, a pair of ring holders 124, 125, and a pair of D-rings 130, 140 (or simply, rings). Strap cover 170 is sewn to side face 114 of the accessory bag (represented by dashed lines 173) or is coupled to the side face in any known, suitable manner. Cover 170 includes a freely movable flap 172 which serves to cover various components, further discussed below. Rings holders 124 and 125 are lengths of materials that retain D-rings 130 and 140, respectively. Ring holders 124 and 125 are secured to accessory bag 110 with a rivet 127 or by any other known, suitable method or device.

Figure 7:
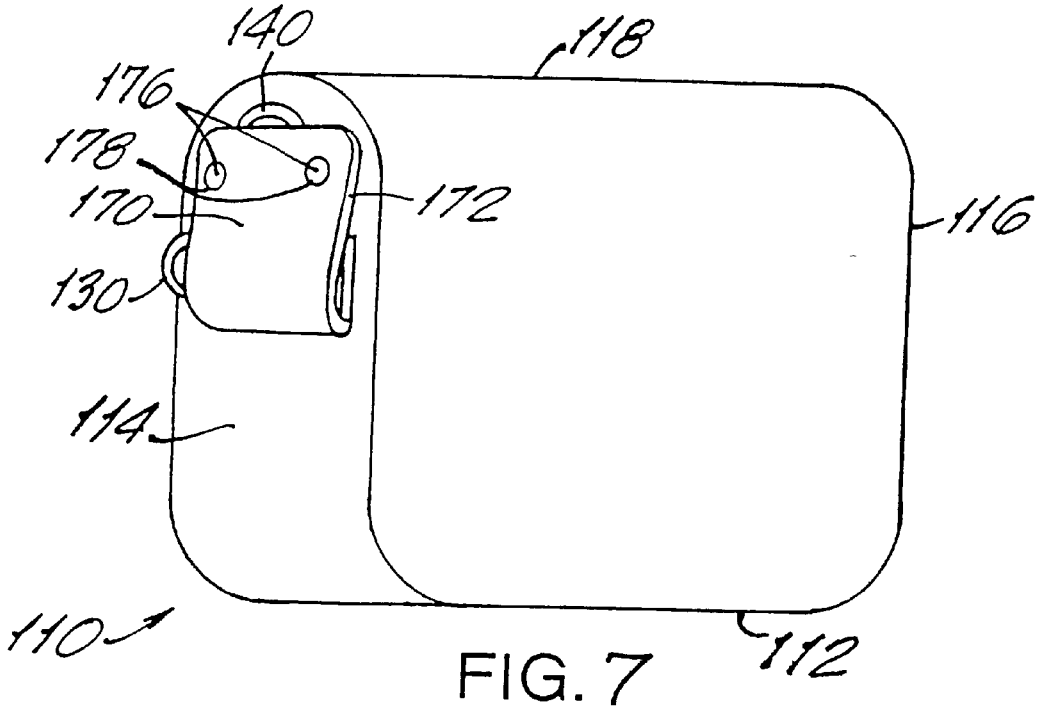
FIG. 7 schematically illustrates the accessory bag of the embodiment shown in FIG. 6, shown with the strap cover connected.

During use of accessory bag 110, flap 172 of strap cover 170 is folded upwards and is secured to the accessory bag by feeding connectors 176 through suitably sized apertures 178 within flap 172, such as shown in FIG. 7. Alternatively, connectors 176 and apertures 178 may be replaced by appropriate snaps, buttons or other devices well known in the art. In the closed position shown in FIG. 7, both rings 130 and 140 are disposed in their respective "exposed" (extended) positions. Thus, an appropriate strap, such as a typical shoulder strap or a typical waist strap, may be connected to an exposed ring on both sides of the bag, as further discussed below.

Figure 8:
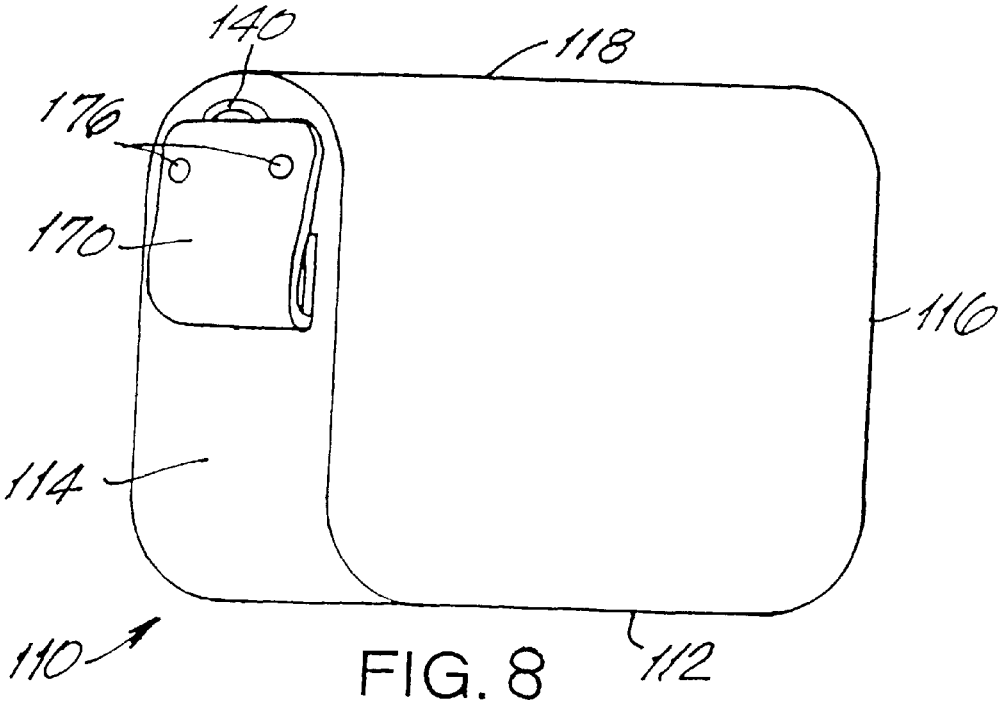
FIG. 8 schematically illustrates the accessory bag of the embodiment shown in FIG. 6, shown with the strap cover connected and with only the shoulder-strap connection ring exposed.
Figure 9:
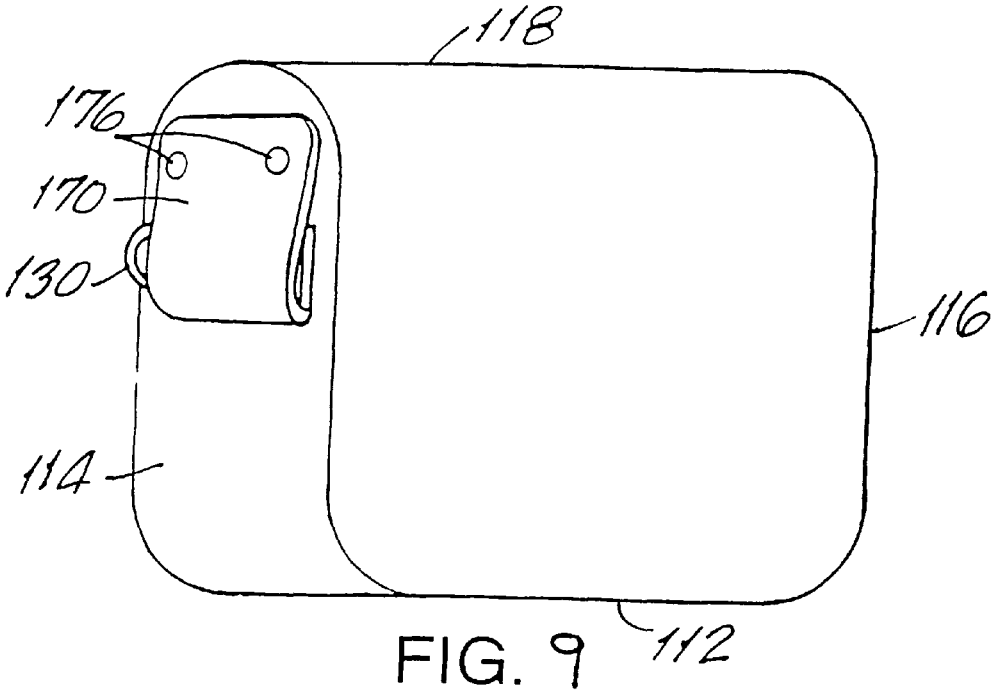
FIG. 9 schematically illustrates the accessory bag of the embodiment shown in FIG. 6, shown with the strap cover connected and with only the waist-strap connection ring exposed.

In accordance with the present invention, accessory bag 110 can be easily modified by the wearer to expose only a single set of rings (i.e., one ring on each side of the bag) to which a single strap is connected. When it is desired to wear accessory bag 110 with a shoulder strap, each of the rings 130 and 140 (on both sides of the bag) are positioned as shown in FIG. 8. In such case, ring 130 is positioned to remain hidden (i.e., concealed) by strap cover 170, whereas ring 140 is positioned to be exposed. Then, the shoulder strap is connected to the exposed rings 140 in an ordinary manner. On the other hand, when it is desired to wear accessory bag 110 with a waist strap, then each of the rings 130 and 140 are positioned as shown in FIG. 9. In such case, ring 130 is positioned to be exposed and ring 140 is positioned to be concealed by strap cover 170. Then, the waist strap is connected to the exposed rings 130 in an ordinary manner.

The positioning by the wearer of each of the rings to enable the accessory bag to be utilized with either a shoulder strap or a waist strap will now be described in further detail, and for convenience, ring 130 also is referred to as waist strap ring 130, and ring 140 also is referred to as shoulder strap ring 140.

Figure 10:
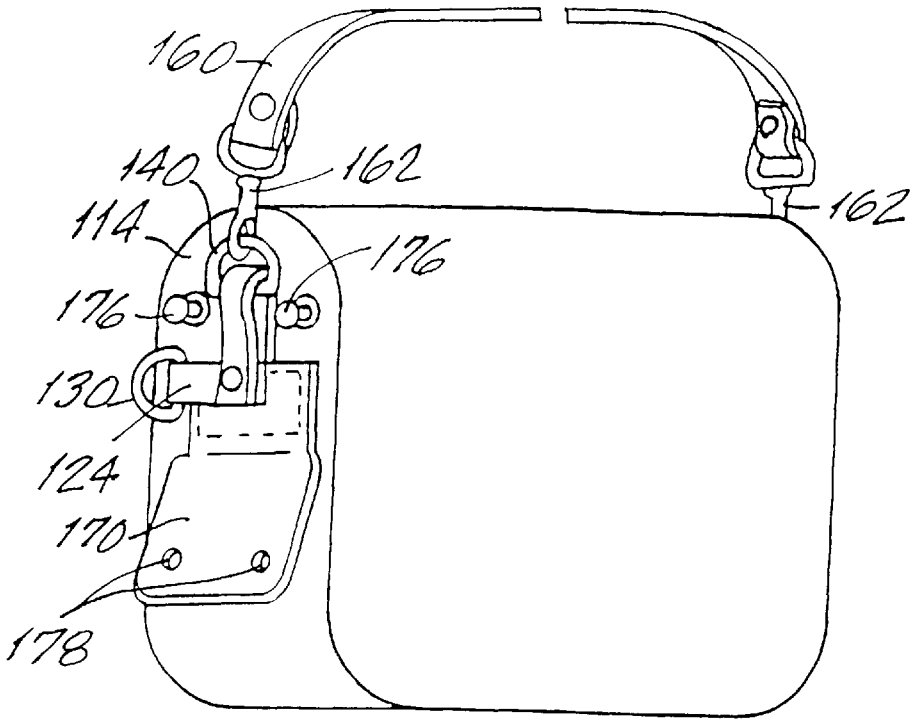
FIGS. 10 and 11 schematically illustrate the accessory bag of the embodiment shown in FIG. 6, shown with the strap cover disconnected and with a shoulder-strap attached.
Figure 11:
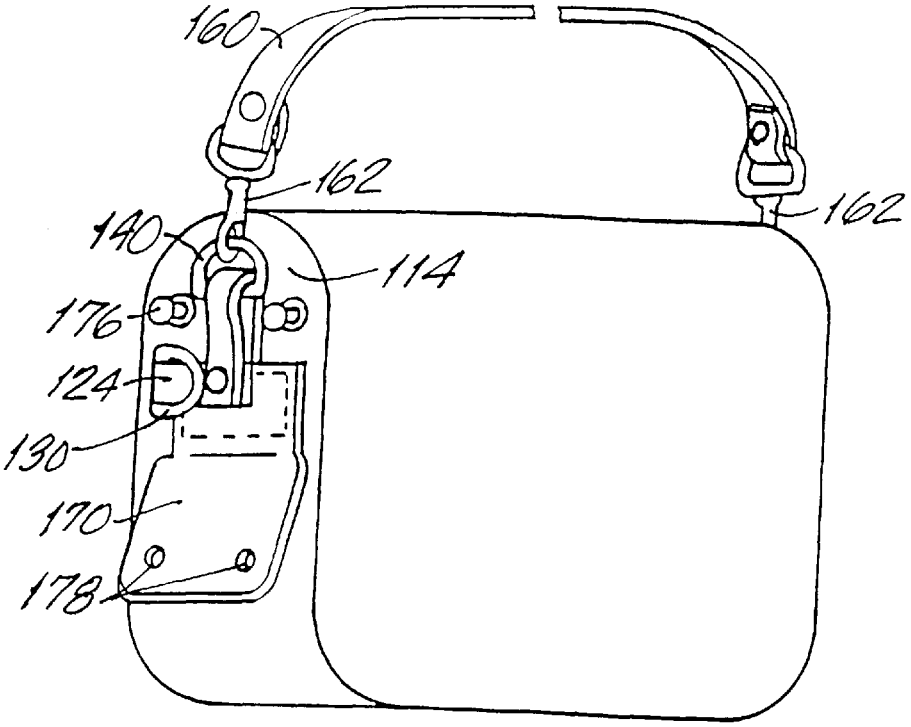
Figure 13:
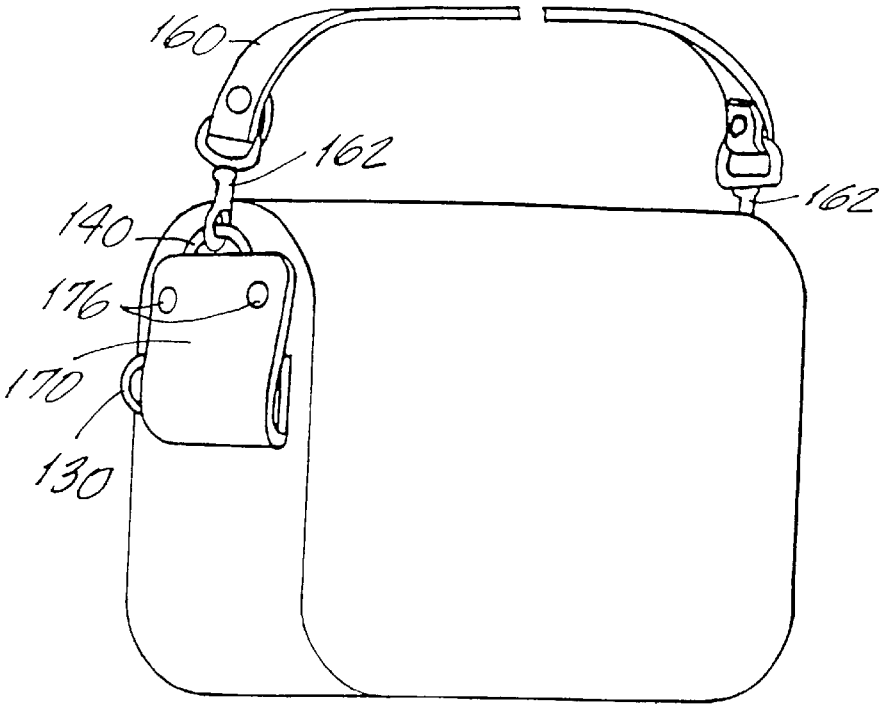
FIG. 13 schematically illustrates the accessory bag in the arrangement shown in FIG. 10, but with the strap cover connected.

Referring to FIG. 10 of the drawings, an ordinary shoulder strap 160 having a pair of connectors 162 is coupled to the accessory bag via shoulder strap rings 140 (on both sides of the bag). Shoulder strap 160 may be coupled to shoulder strap rings 140 while each strap cover 170 is unconnected, such as shown in FIG. 10, or after the strap covers 170 are secured to the bag in the manner previously discussed. To provide each waist strap connector 130 in the previously mentioned concealed position, each connector 130 is turned so that it faces inward (retracted), such as shown in FIG. 11. Finally, the freely movable flap of strap cover 170 is folded upwards and secured to connectors 176, to provide the appearance shown in FIG. 12. Of course, the accessory bag may be used with shoulder strap 160 with both sets of connectors 130 and 140 exposed, such as shown in FIG. 13, but the arrangement shown in FIG. 12 generally is preferred.

Figure 14:
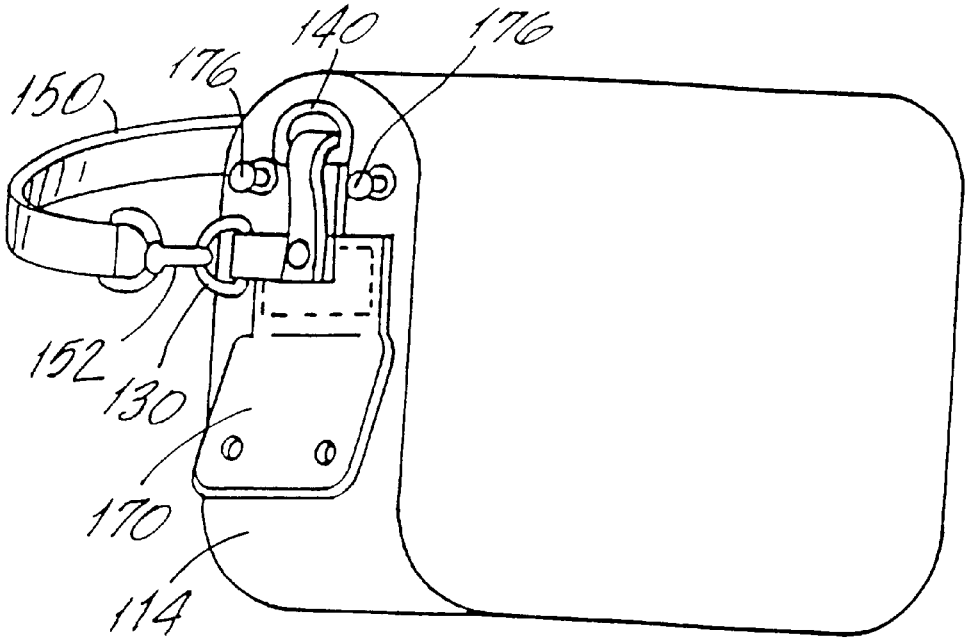
FIGS. 14 and 15 schematically illustrate the accessory bag of the embodiment shown in FIG. 6, shown with the strap cover disconnected and with a waist-strap attached.
Figure 15:
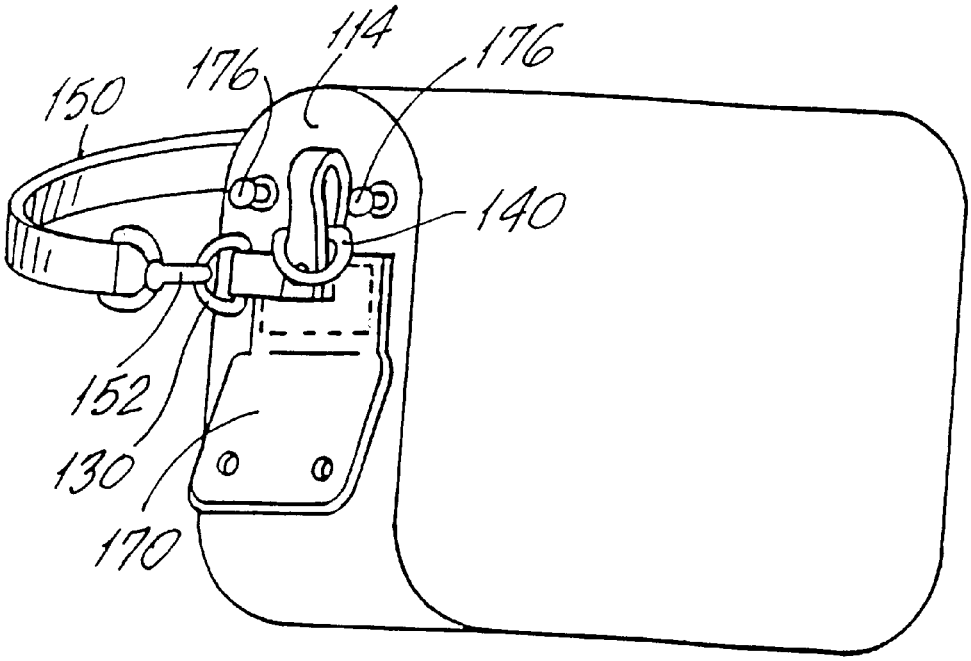
Figure 17:
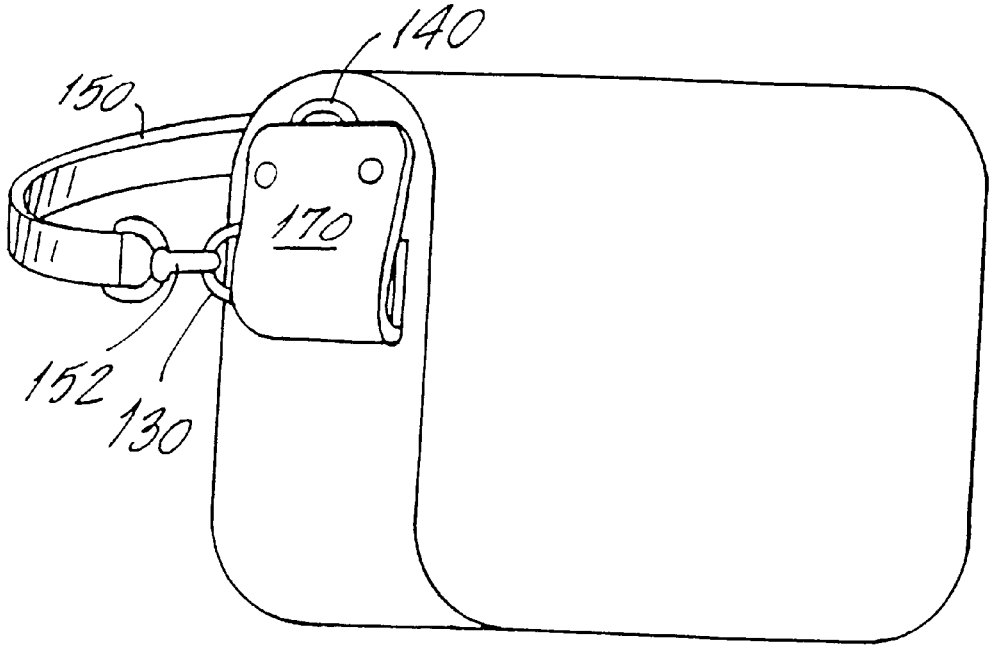
FIG. 17 schematically illustrates the accessory bag in the arrangement shown in FIG. 14, but with the strap cover connected.

When the use of a waist strap is desired, an ordinary waist strap 150 having a pair of connectors 152 is coupled to the accessory bag via waist strap rings 130 (on both sides of the bag), as shown in FIG. 14. Of course, waist strap 150 may be coupled to waist strap rings 130 after the strap covers 170 are already secured to the accessory bag. In either case, each shoulder strap connector 140 is concealed by turning those connectors downward (inward or retracted), as shown in FIG. 15. The freely movable flap of strap cover 170 then is folded upwards and secured to connectors 176, to provide the appearance shown in FIG. 16. Of course, the accessory bag may be used with waist strap 150 with both sets of connectors 130 and 140 exposed, as shown in FIG. 17, but the arrangement shown in FIG. 16 generally is preferred.

Figure 18A:
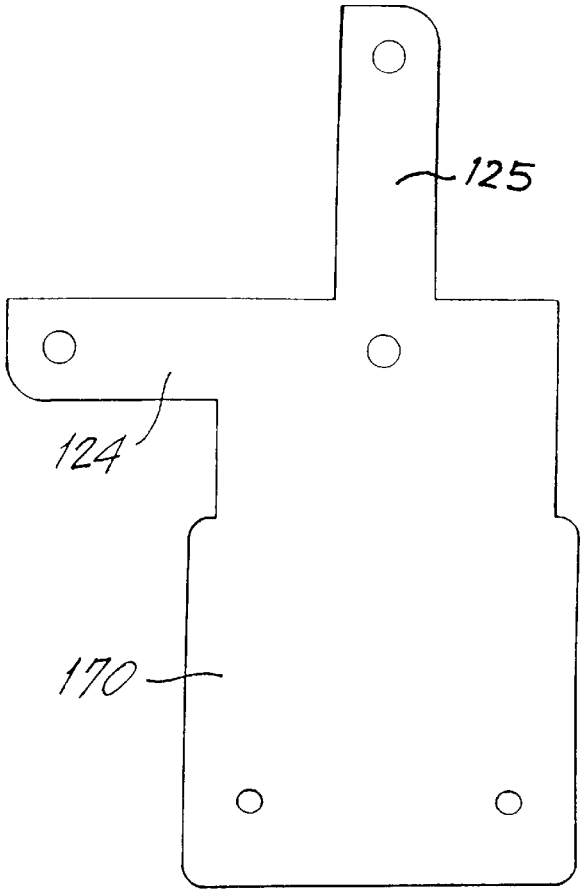
FIGS. 18A and 18B schematically illustrate a particular design of the strap cover of the accessory bag of the present invention.
Figure 18B:
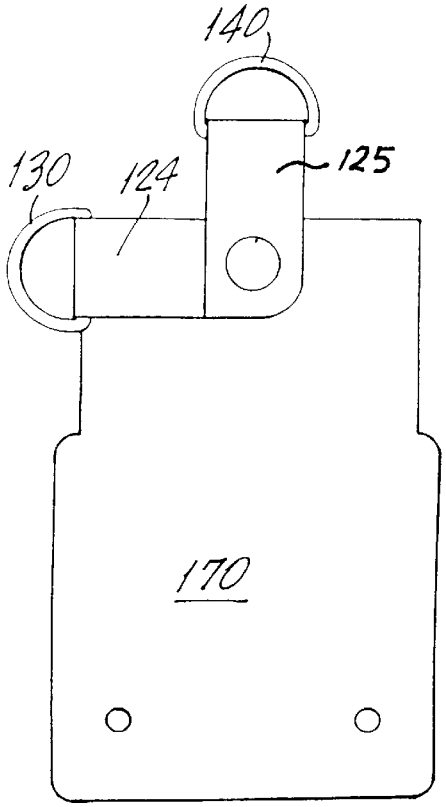

As previously discussed, ring holders 124 and 125 (see FIG. 6) are lengths of material that retain D-rings 130 and 140, respectively, in the manner shown. However, strap cover 170, holder 124 and holder 125 may be constructed from a single piece of material, as shown in FIGS. 18A and 18B. With the cover design shown, the cover includes two relatively narrow extension strips or portions (124, 125), which wrap around and retain the ring holders as previously discussed.

Figure 12:
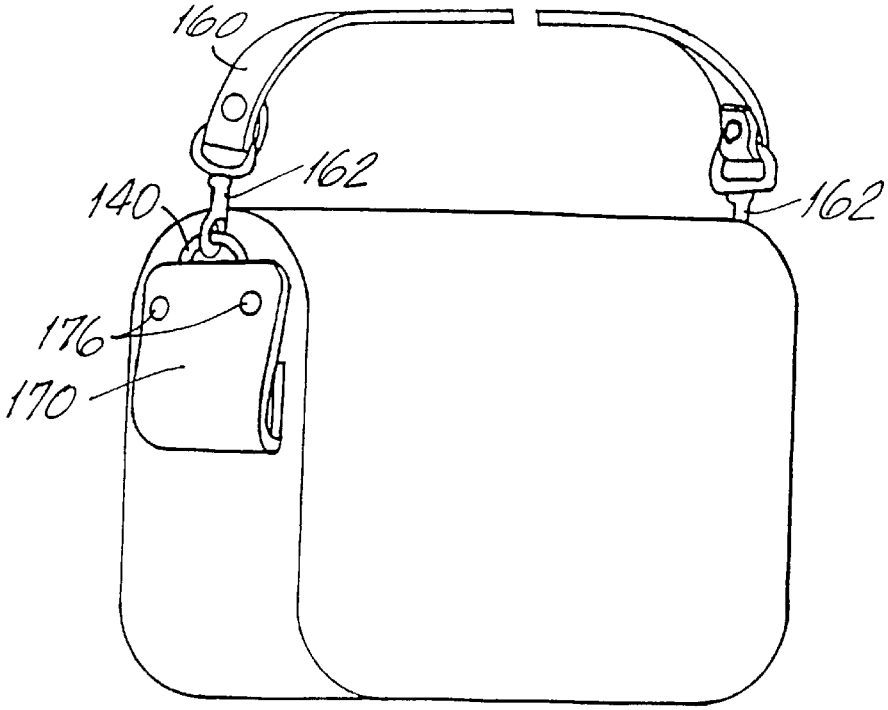
FIG. 12 schematically illustrates the accessory bag in the arrangement shown in FIG. 11, but with the strap cover connected.
Figure 19:
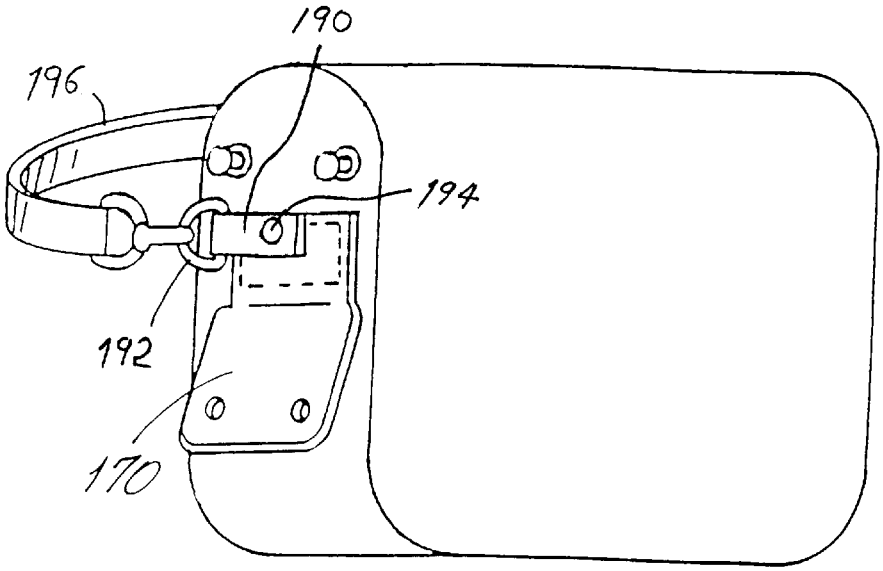
FIGS. 19 and 20 schematically illustrate the accessory bag in accordance with yet another embodiment of the present invention.
Figure 20:
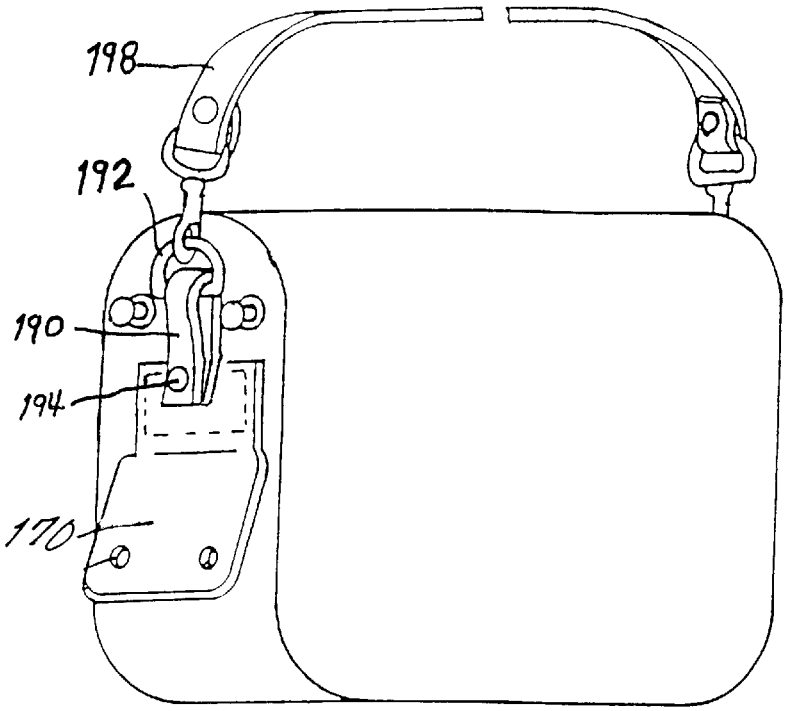

Referring now to FIGS. 19 and 20 of the drawings, a further alternative embodiment of the accessory bag of the present invention is shown. Here, the accessory bag includes nearly all of the same components as in the embodiment shown in FIGS. 6–17, except only a single ring holder 190 with a single connected D-ring 192 are provided on each side of the handbag. In this embodiment, ring holder 190 is coupled to the handbag by a rivet 194, or other suitable connection means, in a manner that allows ring holder 190 to pivot from the position shown in FIG. 19 (waist position) to the position shown in FIG. 20 (shoulder position), and back. Thus, the handbag of the present invention can be utilized with a waist strap 196 in an efficient and aesthetically pleasing manner when ring holder 190 is placed sideways as shown in FIG. 19 or can be utilized with a shoulder strap 198 when ringer holder 190 is placed upwards as shown in FIG. 20. Then, when strap cover 170 is closed in the manner previously discussed, the handbag of the present invention appears as shown in FIG. 12 when used with a shoulder strap, or as shown in FIG. 16 when used with a waist-strap.

Figure 16:
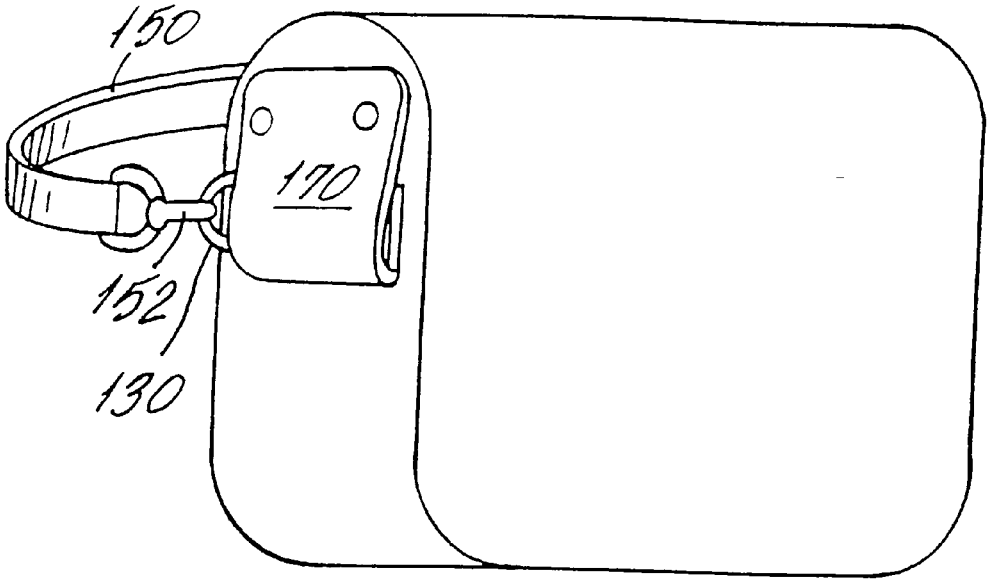
FIG. 16 schematically illustrates the accessory bag in the arrangement shown in FIG. 15, but with the strap cover connected.

As a modification of the embodiment shown in FIGS. 19 and 20, the handbag of the present invention may be utilized with a single strap (e.g., strap 196) in either orientation, that is, in the shoulder-type configuration (FIG. 12) or in the waist-type configuration (FIG. 16). In such case, the handbag is easily modified to change from being a shoulder-type handbag to a fannie-pack type handbag, or visa versa, without any need to connect or disconnect different types of straps. The wearer need only to disconnect strap cover 170, pivot the handbag's ring holder (on each side of the bag) and then re-connect strap cover 170. The length of the single strap may be needed to be adjusted, which is achieved by including any known strap adjustment device (e.g., mechanism 54 in FIG. 4) on the strap itself.

Figure 21:
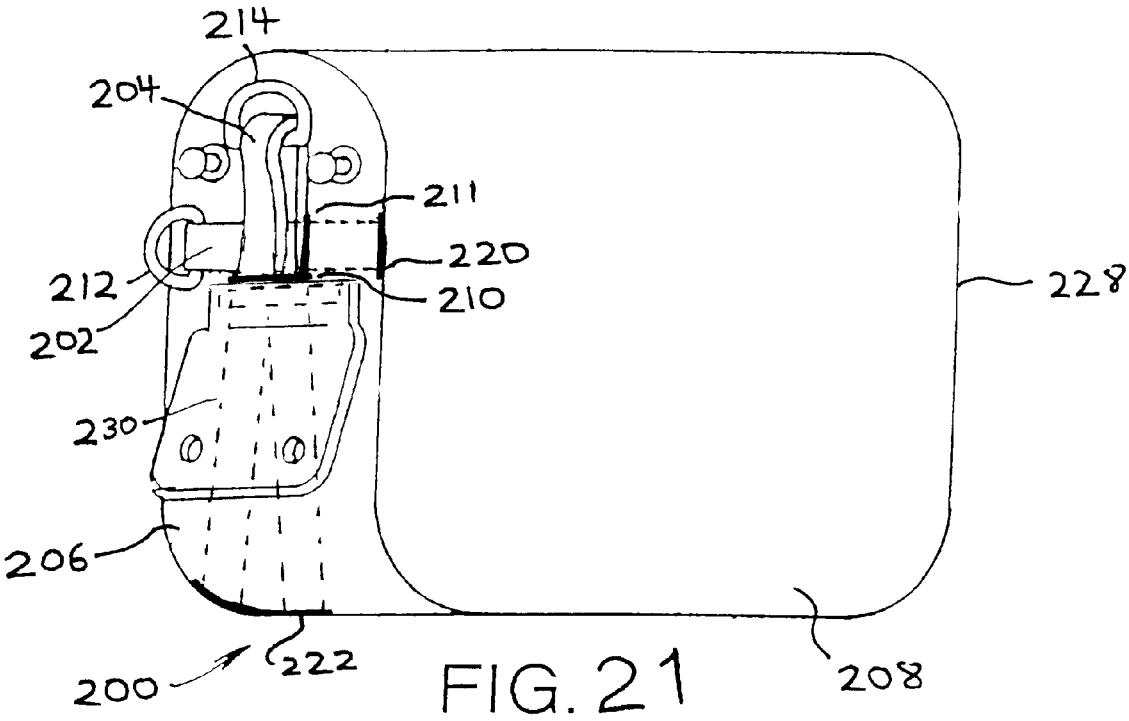
FIG. 21 schematically illustrates the accessory bag in accordance with yet a further embodiment of the present invention.

Referring next to FIG. 21, an accessory bag (handbag) 200 in accordance with yet another embodiment of the present invention is shown. As will be appreciated, handbag 200 includes various features of the first herein-described embodiment shown in FIGS. 1 and 2, and further includes various features of the embodiment shown in FIGS. 6–17. Handbag 200 includes two pieces of material 202 and 204 that, like material 24 shown in FIG. 1D, partially extend through horizontal incision 210 and vertical incision 211, respectively, within the handbag's side wall 206. The open ends of each of the pieces of material are sewn into the handbag's seams. Material 202, at its closed end retains ring 212 as shown and its open ends are sewn into seam 220, preferably the same seam between the front panel 208 of the handbag and the handbag's side panel 206, similar to that of the first described embodiment. The closed end of material 204 retains ring 214 and its open ends are sewn into seam 222, which may be the seam between the bottom of the handbag and side panel 206. Of course, each piece of material 202 and 204 may overlap itself where the ends are together, like the embodiment shown in FIG. 1D, or may be provided with their ends apart, such as shown in FIG. 3B. The other side panel 228 includes each of these components as well.

Handbag 200 shown in FIG. 21 further includes strap cover 230 which is substantially similar to strap cover 170 previously discussed or, alternatively, may have one of the designs shown in FIGS. 5A–5C, or other suitable design. Moreover, rings 212 and 214 may be either concealed or revealed by turning them inwards or outwards in the manner previously discussed with respect to the embodiment shown in FIGS. 6–17, and either a waist-strap or a shoulder-strap can be utilized with handbag 200 in the manner previously described.

Figure 22:
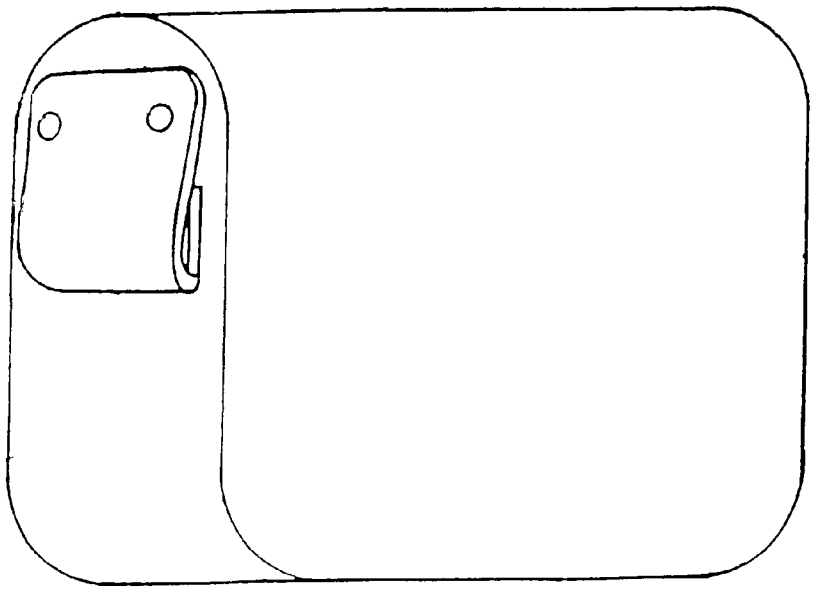
FIG. 22 schematically illustrates the accessory bag with the strap cover connected and with neither of the connections rings exposed.

Finally, it is appreciated that the handbag of the present invention, in accordance with any of the above-discussed embodiments and features, may be utilized without either a shoulder-strap or a waist-strap. In such case, it may be preferred to conceal all of the connection rings (e.g., rings 130, 140, 192, 212, 214, etc.). This is accomplished by concealing both rings 130, 140 on the two sides of the bag, for the embodiment shown in FIGS. 6–17 (or rings 212, 214 in FIG. 21), in the manner already discussed. Or, when each side only includes a single ring 192, as in the embodiment shown in FIGS. 19–20, simply concealing (i.e., turning inward or downward) ring 192. Then, when the strap cover is closed, the handbag of the present invention provides the appearance shown in FIG. 22.

While the present invention has been particularly shown and described in conjunction with preferred embodiments thereof, it will be readily appreciated by those of ordinary skill in the art that various changes may be made without departing from the spirit and scope of the invention. For example, the present invention should not be limited to the specific styles, sizes and shapes discussed herein and shown in the drawings and should be applied to generally any style, size and bag shape. As another example, the discussion is directed to attaching a waist-strap, as well as a shoulder strap, to coupling mechanisms attached to the side panels of a bag. However, the present invention is not limited solely to such construction and is equally applicable to providing coupling mechanisms, as well as the strap covers, on any part of the accessory bag, including the front panel, rear panel, top panel and bottom panel.

Therefore, it is intended that the appended claims be interpreted as including the embodiments described herein, the alternatives mentioned above, and all equivalents thereto.

What is claimed is:

1. An accessory bag, comprising:

front and rear surfaces;

two side surfaces, each of said side surfaces being attached to said forward and rear surfaces;

a first shoulder strap connector coupled to a first of said two side surfaces and adapted to connect to an end of a shoulder strap, a first waist strap connector coupled to said first of said two side surfaces and adapted to connect to an end of a waist strap, a second shoulder strap connector coupled to a second of said two side surfaces and adapted to connect to an end of a shoulder strap, a second waist strap connector coupled to said second of said two side surfaces and adapted to connect to an end of a waist strap, a first strap cover coupled to said first of said two side surfaces and adapted to be positioned in an open position and in a closed position, said first strap cover concealing at least portions of both said first shoulder strap connector and said first waist strap connector when in the closed position; and a second strap cover coupled to said second of said two side surfaces and adapted to be positioned in an open position and in a closed position, said second strap cover covering at least portions of both said second shoulder strap connector and said second waist strap connector when in the closed position.

2. The accessory bag of claim 1, wherein each of said first and second shoulder strap connectors and each of said first and second waist strap connectors includes a respective movable ring, the rings of each of the connectors being movable between a respective first position and a respective second position; said first and second strap covers when in the respective closed positions fully concealing the respective rings of the first and second shoulder strap connectors when in the respective first position, and at least partially exposing the respective rings of the first and second shoulder strap connectors when in the respective second positions.

3. The accessory bag of claim 2, wherein said first and second strap covers, when in the respective closed positions, fully conceal the respective rings of the first and second waist strap connectors when in the respective first position, and at least partially expose the respective rings of the first and second waist strap connectors when in the respective second positions.

4. The accessory bag of claim 1, wherein said first strap cover fully exposes said first shoulder strap connector and said first waist strap connector when in the open position; and said second strap cover fully exposes said second shoulder strap connector and said second waist strap connector when in the open position.

5. The accessory bag of claim 1, wherein each of said first and second shoulder strap connectors and each of said first and second waist strap connectors includes a respective fixed component affixed to one of said two side surfaces and a respective ring coupled to the respective fixed component; each of the rings being adapted to connect to at least one of the waist straps and shoulder straps, each of the rings movable between an extended position and a retracted position; said first strap cover when in the closed position fully concealing said first shoulder strap connector when in the retracted position and fully concealing said first waist strap connector when in the retracted position; said second strap cover when in the closed position fully concealing said second shoulder strap connector when in the retracted position and fully concealing said second waist strap connector when in the retracted position.

6. The accessory bag of claim 5, wherein said first strap cover when in the closed position at least partially exposes said first shoulder strap connector when in the extended position and at least partially exposes said first waist strap connector when in the extended position; said second strap cover when in the closed position at least partially exposes said second shoulder strap connector when in the extended position and at least partially exposes said second waist strap connector when in the extended position.

7. The accessory bag of claim 6, wherein said first strap cover when in the open position fully exposes both said first shoulder strap connector and said first waist strap connector when in either the respective retracted or extended positions; and said second strap cover when in the open position fully exposes both said second shoulder strap connector and said second waist strap connector when in either the respective retracted or extended positions.

8. The accessory bag of claim 1, wherein said first and second shoulder strap connectors extend upwardly from the respective first and second side surfaces of the accessory bag; and said first and second waist strap connectors extend sideways from the respective first and second side surfaces of the accessory bag.

9. The accessory bag of claim 1, wherein each of said first and second strap covers includes a first cover portion fixed to the respective side surface of the accessory bag and a second cover portion extending from the first cover portion and pivotable between the respective open and closed positions; the accessory bag further comprising strap connectors fixed to respective sides of the accessory bag for selectively maintaining said first and second strap covers in the respective closed positions.

10. The accessory bag of claim 1, wherein each of said first and second shoulder strap connectors and each of said first and second waist strap connectors is a respective connection ring; each of said first and second strap covers is comprised of a single piece of material having a fixed body portion fixed to a respective side of the accessory bag, a movable body portion extending from said first body portion and movable between the open and closed positions, a first narrow extension portion extending from said fixed body portion and a second narrow extension portion extending from said fixed body portion; said first and second narrow extension portions of said first and second strap covers each being adapted to retain a respective one of the connection rings.

11. The accessory bag of claim 10, wherein the first narrow extension portion of each of said first and second strap covers extends from a top of the respective strap cover and is adapted to retain one of the shoulder strap connectors; and the second narrow extension portion of each of said first and second strap covers extends from a side of the respective strap cover and is adapted to retain one of the waist strap connectors.

12. An accessory bag adapted to be worn by a wearer, comprising:

front and rear surfaces;

two side surfaces, each of said side surfaces being attached to said forward and rear surfaces;

a first shoulder strap connector coupled to a first of said two side surfaces and adapted to connect to an end of a strap, a first waist strap connector coupled to said first of said two side surfaces and adapted to connect to an end of a strap, a second shoulder strap connector coupled to a second of said two side surfaces and adapted to connect to an end of a strap, a second waist strap connector coupled to said second of said two side surfaces and adapted to connect to an end of a strap, a first strap cover coupled to said first of said two side surfaces and adapted to be positioned in an open position and in a closed position, said first strap cover concealing at least portions of both said first shoulder strap connector and said first waist strap connector when in the closed position;

a second strap cover coupled to said second of said two side surfaces and adapted to be positioned in an open position and in a closed position, said second strap cover covering at least portions of both said second shoulder strap connector and said second waist strap connector when in the closed position; and at least one strap having two ends selectively coupled between the first and second shoulder strap connectors or between the first and second waist strap connectors, the accessory bag operating as a shoulder-type bag when the strap is coupled between the first and second shoulder strap connectors, and the accessory bag operating as a waist-type bag when the strap is coupled between the first and second waist strap connectors.

13. The accessory bag of claim 12, wherein each of said first and second shoulder strap connectors and each of said first and second waist strap connectors includes a respective movable ring, the rings of each of the connectors being movable between a respective first position and a respective second position, said first and second strap covers, when in the respective closed positions, fully concealing the respective rings of the first and second shoulder strap connectors when in the respective first position, and at least partially exposing the respective rings of the first and second shoulder strap connectors when in the respective second positions.

14. The accessory bag of claim 13, wherein said first and second strap covers, when in the respective closed positions, fully conceal the respective rings of the first and second waist strap connectors when in the respective first position, and at least partially expose the respective rings of the first and second waist strap connectors when in the respective second positions.

15. The accessory bag of claim 12, wherein said first strap cover fully exposes said first shoulder strap connector and said first waist strap connector when in the open position; and said second strap cover fully exposes said second shoulder strap connector and said second waist strap connector when in the open position.

16. The accessory bag of claim 12, wherein said first and second shoulder strap connectors extend upwardly from the respective first and second side surfaces of the accessory bag; and said first and second waist strap connectors extend sideways from the respective first and second side surfaces of the accessory bag.

17. The accessory bag of claim 12, wherein each of said first and second strap covers includes a first cover portion fixed to the respective side surface of the accessory bag and a second cover portion extending from the first cover portion and pivotable between the respective open and closed positions; the accessory bag further comprising strap connectors fixed to respective sides of the accessory bag for selectively maintaining said first and second strap covers in the respective closed positions.

18. The accessory bag of claim 12, wherein each of said first and second shoulder strap connectors and each of said first and second waist strap connectors is a respective connection ring; each of said first and second strap covers is comprised of a single piece of material having a fixed body portion fixed to a respective side of the accessory bag, a movable body portion extending from said first body portion and movable between the open and closed positions, a first narrow extension portion extending from said fixed body portion and a second narrow extension portion extending from said fixed body portion; said first and second narrow extension portions of said first and second strap covers each being adapted to retain a respective one of the connection rings.

19. The accessory bag of claim 12, wherein said at least one strap is comprised of a shoulder strap and a waist strap, said shoulder strap selectively coupled between the first and second shoulder strap connectors, and said waist strap selectively coupled between the first and second waist strap connectors, the accessory bag adapted to be used as a shoulder-type bag when only the shoulder strap is coupled between the first and second shoulder strap connectors, and the accessory bag adapted to be used as a waist-type bag when only the waist strap is coupled between the first and second waist strap connectors.

20. An accessory bag, comprising:

front and rear surfaces;

two side surfaces, each of said side surfaces being attached to said forward and rear surfaces;

a first strap connector coupled to a first of said two side surfaces and pivotable between a shoulder position and a waist position, said first strap connector adapted to connect to an end of a shoulder strap when in the shoulder position and adapted to connect to an end of a waist strap when in the waist position;

a second strap connector coupled to a second of said two side surfaces and pivotable between a shoulder position and a waist position, said second strap connector adapted to connect to an end of a shoulder strap when in the shoulder position and adapted to connect to an end of a waist strap when in the waist position;

a first strap cover coupled to said first of said two side surfaces and adapted to be positioned in an open position and in a closed position, said first strap cover when in the closed position concealing at least a portion of said first strap connector when in either the shoulder position or the waist position; and a second strap cover coupled to said second of said two side surfaces and adapted to be positioned in an open position and in a closed position, said second strap cover when in the closed position concealing at least a portion of said second strap connector when in either the shoulder position or the waist position.

21. The accessory bag of claim 20, wherein each of said first and second strap connectors includes a respective movable ring , the rings of each of the connectors being movable between a respective extended position and a respective retracted position; said first and second strap covers, when in the respective closed positions, fully concealing the respective rings of the first and second strap connectors when in the respective retracted positions, and at least partially exposing the respective rings when in the respective extended positions.

22. The accessory bag of claim 20, wherein said first strap cover fully exposes said first strap connector when in the open position; and said second strap cover fully exposes said second strap connector when in the open position.

23. The accessory bag of claim 20, wherein said first and second strap connectors extend upwardly from the respective first and second side surfaces of the accessory bag when in the respective shoulder positions; and said first and second strap connectors extend sideways from the respective first and second side surfaces when in the respective waist positions.

24. The accessory bag of claim 20, further comprising a shoulder strap adapted to be worn on a shoulder of the wearer, the shoulder strap having first and second ends, said first end of said shoulder strap coupled to said first strap connector in the shoulder position, and said second end of said shoulder strap coupled to said second strap connector in the shoulder position.

25. The accessory bag of claim 20, further comprising a waist strap adapted to be worn around a waist of the wearer, the waist strap having first and second ends, said first end of said waist strap coupled to said first strap connector in the waist position, and said second end of said waist strap coupled to said second strap connector in the waist position.

26. The accessory bag of claim 20, further comprising a strap having first and second ends coupled to the respective first and second strap connectors, the strap being adapted to be worn on a shoulder of the wearer when the first and second strap connectors are in the respective shoulder positions, and the strap being adapted to be worn around a waist of the wearer when the first and second strap connectors are in the respective waist positions.

27. An accessory bag, comprising:

forward, rear and bottom surfaces;

two side surfaces; each of said side surfaces being attached to said forward, rear and bottom surfaces along respective seams, a first pair of attachment devices adapted to receive a respective end of a shoulder-strap;

a second pair of attachment devices adapted to receive a respective end of a waist-strap;

a first pair of retaining means coupled to said accessory bag along respective first seams of said side surfaces for retaining respective attachment devices of said first pair;

a second pair of retaining means coupled to said accessory bag along respective second seams of said side surfaces for retaining respective attachment devices of said second pair, said respective first seams and said respective second seams of said side surfaces being different.

28. The accessory bag of claim 27, wherein said first pair of retaining means is coupled to said accessory bag along respective seams attaching said side surfaces to said bottom surface.

29. The accessory bag of claim 27, wherein said second pair of retaining means is coupled to said accessory bag along respective seams attaching said side surfaces to said front surface.

30. The accessory bag of claim 27, further comprising two covers coupled to respective side surfaces and adapted to be positioned in respective open and closed positions, each of said two covers concealing at least portions of respective attachment devices of said first and second pair when in the closed position.

* * * * *